US008171582B1

(12) United States Patent
Nikolaev et al.

(10) Patent No.: US 8,171,582 B1
(45) Date of Patent: May 8, 2012

(54) MULTIFUNCTIONAL BED

(75) Inventors: Petr Vladimirovich Nikolaev, Moscow (RU); Yakov Benediktovich Ulanovsky, Moscow (RU); Elena Yakovlevna Kozlova, Moscow (RU); Ivan Petrovich Nikolaev, Moscow (RU); Mikhail Yakovlevich Ulanovsky, Moscow (RU); Alena Petrovna Nikolaeva, Moscow (RU)

(73) Assignee: Obshhestvo S Organichennoj Otvetstvennost'Yu Strojinzhiniring SM, Moscow (RU)

( * ) Notice: Subject to any disclaimer, the term of this patent is extended or adjusted under 35 U.S.C. 154(b) by 0 days.

(21) Appl. No.: 13/375,760

(22) PCT Filed: May 31, 2010

(86) PCT No.: PCT/RU2010/000280

§ 371 (c)(1),
(2), (4) Date: Feb. 2, 2012

(87) PCT Pub. No.: WO2010/140925

PCT Pub. Date: Dec. 9, 2010

(30) Foreign Application Priority Data

Jun. 4, 2009 (RU) ..... 2009121312

(51) Int. Cl.

| | |
|---|---|
| ***A61G 7/00*** | (2006.01) |
| ***A61G 7/008*** | (2006.01) |
| ***A61G 7/005*** | (2006.01) |
| ***A61G 7/012*** | (2006.01) |
| ***A61G 7/018*** | (2006.01) |
| ***A61G 7/02*** | (2006.01) |
| ***A61G 7/043*** | (2006.01) |

(52) U.S. Cl. ..... 5/600; 5/608; 5/611; 5/604; 5/915

(58) Field of Classification Search ..... 5/600, 604–611, 5/11, 915

See application file for complete search history.

(56) References Cited

U.S. PATENT DOCUMENTS

| | | | | |
|---|---|---|---|---|
| 520,576 | A * | 5/1894 | Scearce | 5/83.1 |
| 874,555 | A * | 12/1907 | Woollen | 5/607 |
| 3,434,165 | A * | 3/1969 | Keane | 5/608 |
| 4,175,550 | A * | 11/1979 | Leininger et al. | 601/5 |
| 4,868,937 | A * | 9/1989 | Connolly | 5/608 |
| 6,282,736 | B1 * | 9/2001 | Hand et al. | 5/608 |
| 6,499,160 | B2 * | 12/2002 | Hand et al. | 5/608 |
| 6,691,347 | B2 * | 2/2004 | Hand et al. | 5/607 |
| 2002/0026671 | A1 * | 3/2002 | Hand et al. | 5/608 |
| 2003/0115673 | A1 * | 6/2003 | Hand et al. | 5/608 |
| 2006/0101581 | A1 | 5/2006 | Blanchard et al. | |

FOREIGN PATENT DOCUMENTS

| | | | |
|---|---|---|---|
| CN | 201094707 | Y | 8/2008 |
| SU | 1621924 | A1 | 1/1991 |
| SU | 1666108 | A1 | 7/1991 |

* cited by examiner

*Primary Examiner* — Robert G Santos

(74) *Attorney, Agent, or Firm* — Knobbe Martens Olson & Bear LLP

(57) ABSTRACT

The invention relates to therapeutic-prophylactic equipment and domestic articles and can be used in the home for the care of seriously ill patients having limited mobility or being completely immobile as well as for the prophylactic treatment of temporarily immobile patients. The use of the proposed bed makes it possible to combine various methods for acting on the body, thereby making it possible to take measures for the efficient prevention and healing of a wide range of diseases. This, together with all the listed means and the interactions thereof, makes it possible to enhance and widen the healing effect and improve service quality.

3 Claims, 5 Drawing Sheets

Section S-S

MULTIFUNCTIONAL BED

Figure 1:
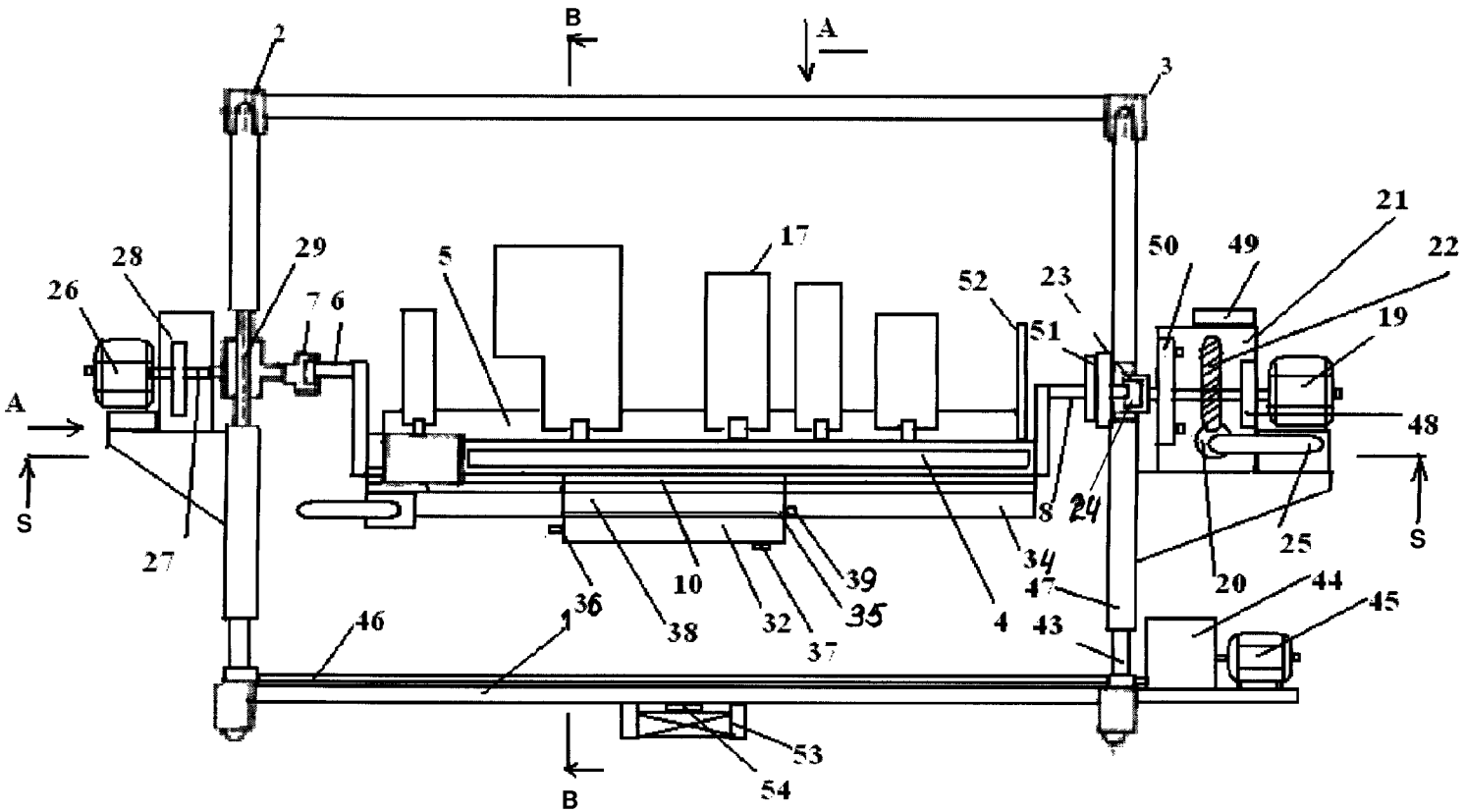

The present invention relates to medical equipment, namely to beds for seriously ill patients, and can be used in healthcare institutions and in homes for nursing seriously ill patients with restricted mobility or complete immobility, and also for the treatment of temporarily immobilized patients.

A functional bed is known that consists of a base and sectional upper (sleeping) platform, which for the sake of the patient's comfort can be transformed into a chair; a bedpan and gear for adjusting the same; and a mechanical device for changing the form of the sectional upper platform, with the device for adjusting the bedpan and the device for changing the form of the sectional upper platform being designed as a system of levers and electromechanical devices/linear actuators (RF patent No. 2221534).

The disadvantage of the known bed is the virtual impossibility to perform sanitation of the patient and complexity of water supply and sanitation waste removal. Besides, this bed is difficult to construct and too bulky; the bed use requires much effort and presence of medical personnel due to the complicated design of the arrangement used to position the patient in the bed; and superfluous functions built into the bed make the bed more labor-consuming in maintenance.

A functional bed is known that consists of a base with bed-rails, a frame connected with said rails, an upper platform installed in said frame, a device rotating the frame around a horizontal axis, an upper platform locking device and a patient supporting unit. The upper (sleeping) platform has supports for the accommodation of the patient, with the means of patient support made in the form of a number of belts and a plank, and the upper platform locking device being made of clips providing for keeping the upper platform within the frame and preventing the patient from falling and sliding over when being rotated together with the frame (Patent No. RU 2317803).

The disadvantage of the known bed design is the impossibility of full-scale sanitation of a patient, lack of reliable and sparing fixation of a bedridden patient, which results in lower quality of care. The upper platform rotation management is difficult and requires much effort on the part of the personnel, which complicates the nursing of the patient.

A hospital bed is known that comprises a base, bed-rails, a frame with an upper platform, a frame rotation device rotating the frame with the upper platform around a horizontal or vertical axis, and means of fixing the patient's position. Each device is equipped with a worm gear of its own (Patent No. RU 2186555). The disadvantage of the known bed design is the fact that, although repositioning of the patient in the bed is possible, such action must be performed manually, which requires much effort; there is no system of patient sanitation; fixation of the patient is performed with belts, which can result in inflicting injuries to the patient during any repositioning of the patient.

Besides, none of the aforementioned designs can be used for the care of seriously ill and bedridden patients, e.g. after spine, skull, abdominal cavity or thoracic cavity surgery, when it is important to exclude loading of a specific body part; or avoid stagnation in the respiratory system or circulatory system; and prevent bedsores and stagnatory effects in the organs and systems of the patient, i.e. manage the patient repositioning according to a certain program reflecting medical indications and prescribed by a doctor. The nursing of a patient with the use of the known beds is labor-consuming and inconvenient.

A hospital bed is known that comprises a base, bed-rails, a frame with axial rods at its end portions, a upper platform installed with the help of locking devices, removable pneumatic clamps for supporting the patient, a rotating device for the rotation of the frame around a horizontal axis with an actuator and a worm-and-worm pair connected with one of the axial rods via a coupling device and a U-shaped bracket, a mechanical arrangement for vertically tilting the frame that consists of a carriage with a capability of moving along the lead screw and connected with the upper platform by means of a rack and hinges (Patent No. RU 1666108).

The known bed design lacks the capability of patient repositioning in space as needed according to his condition and doctor prescriptions; there are only options of rotating the patient relative to a horizontal axis and tilting the bed's upper platform. The design of the bed's upper platform tilting unit is overcomplicated. There is no capability of sanitation of the patient. The patient's position during rotation is inconvenient for the medical personnel managing the bed. Accidental patient injuries cannot be excluded during rotation, which is inadmissible, especially in nursing bedridden patients, e.g. after spine, skull, abdominal cavity or thoracic cavity surgery etc. Also, the bed design allows neither for eliminating constant loading on the patient's body surface resulting in bedsores, nor for the provision of continual repositioning of the patient's body in order to improve the functioning of vital body systems.

Thus, none of the bed designs known to the present authors intended for seriously ill and bedridden patients allows for providing necessary conditions for nursing such patients and ensuring ease of service by medical personnel at the same time; i.e. there is a need for an easy-to-service multifunctional bed that would allow for the provision of proper care of the patient and make it possible to perform rehabilitation activities contributing to convalescence and recovery of the patient.

The objective of this invention is to improve quality and reduce labor intensity of nursing a bedridden patient.

The said objective is achieved by the present invention of a multifunctional bed that comprises a base, bed-rails, a frame with axial rods at its end portions, an upper platform installed in the frame, locking devices for the installation of the upper platform in the frame, removable pneumatic clamps for supporting the patient, a rotating device for the rotation of the frame around a horizontal axis with an actuator and a worm-and-worm pair connected with one of the axial rods, a mechanical arrangement for vertically tilting the frame that consists of a carriage with a capability of moving along the lead screw and connected with the upper platform by means of a rack and hinges, said bed being equipped with a device of vertically lifting the frame made in the form of hollow vertical tubes telescopically installed in the bed-rails and connected with each other to form a transportation system connected to the compressor for the supply of a liquid under pressure and an electric actuator, also equipped with an eccentric frame vibration apparatus connected to one of the bed axial rods, a sanitation arrangement in the form of a sectional net and a pallet beneath the upper platform, the sections thereof being removable, and a trough-like duct installed beneath the pallet and equipped with water supply and sanitation waste removal fittings, said sections of the net and pallet being installed with horizontal movement capability, and the frame rotation device being additionally equipped with a frame rotation control system that includes an electronic device to transmit electronic control signals to the actuator, a packet-type switch for changing rotation modes or assigning frame rotation angle, and a drum lock for locking the frame angle position, said upper platform being equipped with pins located on its lateral sides installed by means of hinges on inner sides of the frame. Preferably, the bed is additionally equipped with a massaging device made in the form of a carriage installed with a capability to move along the patient's body, with massaging rollers being affixed thereto. Preferably, the bed is additionally equipped with a vibration device made in the form of an electromagnetic actuator whose electromagnetic coil and core are installed in the base of the bed.

The installation, under the upper platform of the bed, of a net and pallet equipped with removable sections installed with horizontal movement capability, and a trough-like duct placed beneath pallet and equipped with water supply and sanitation waste removal fittings, allows for the ease of inspection, treatment and sanitation of appropriate patient body portions given any position of the frame and the upper platform. The upper platform tilting capability in the vertical plane makes it possible to change, for example, bed linens without putting the patient under stress, and can also allow the stretching of the spine or lower extremities by way of elevating one end of the upper platform, facilitating patient care.

The vertical inclination of the upper platform and rotation of the frame, along with frame and upper platform vibration, produce pendulum-like swinging motions that affect the patient and eliminate constant loading of certain patient body parts, almost entirely preventing the formation of stagnation zones in the body. The installation on the proposed multifunctional bed of an electronic device that allows for the creation of an individually adjusted mode of patient repositioning in space makes it possible to reduce time of convalescence of seriously ill patients and improve living conditions of bedridden patients.

The invention is illustrated with drawings, where

Figure 2:
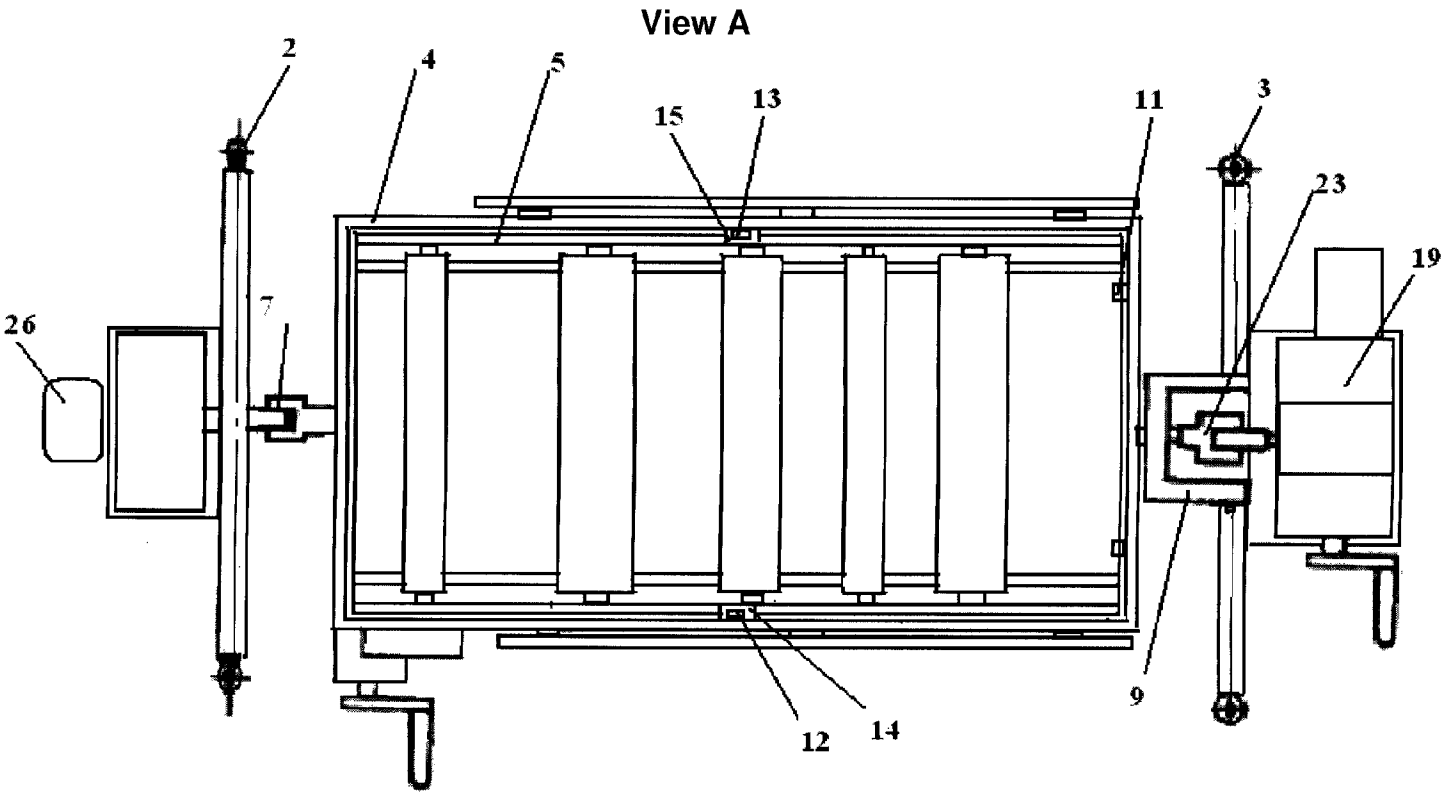
Figure 3:
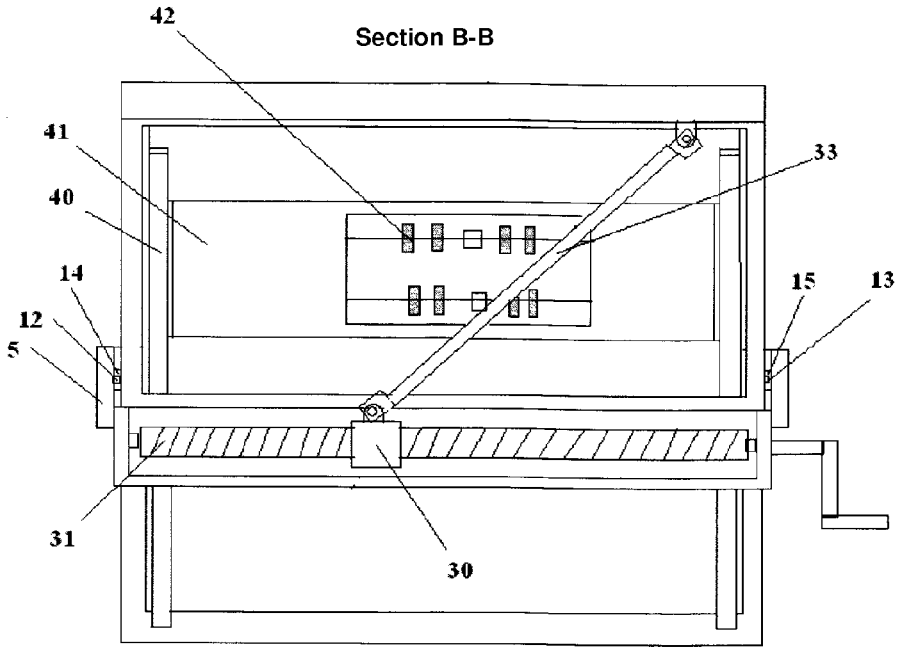
Figure 4:
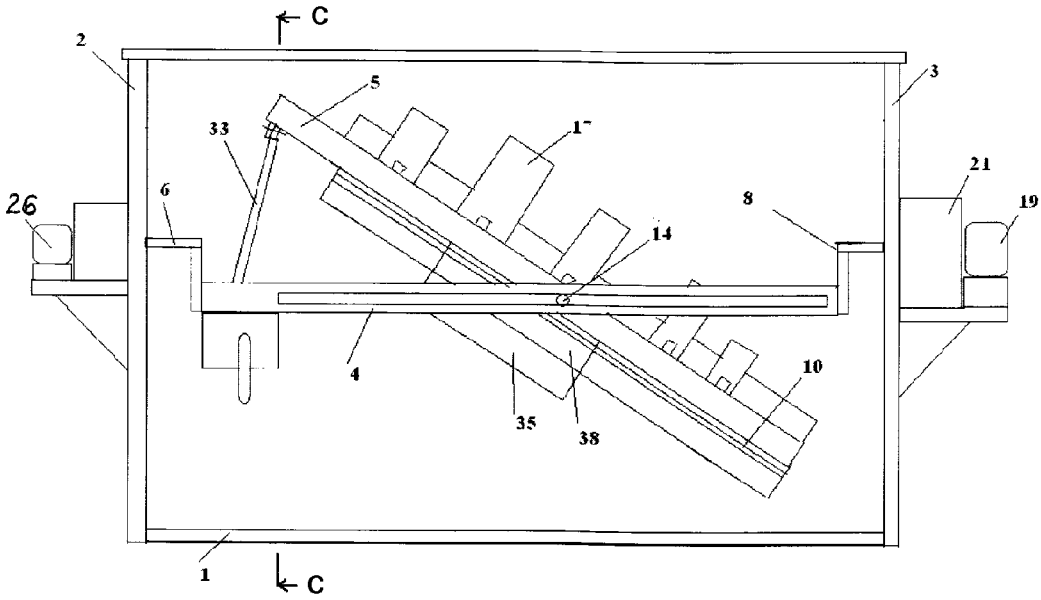
Figure 5:
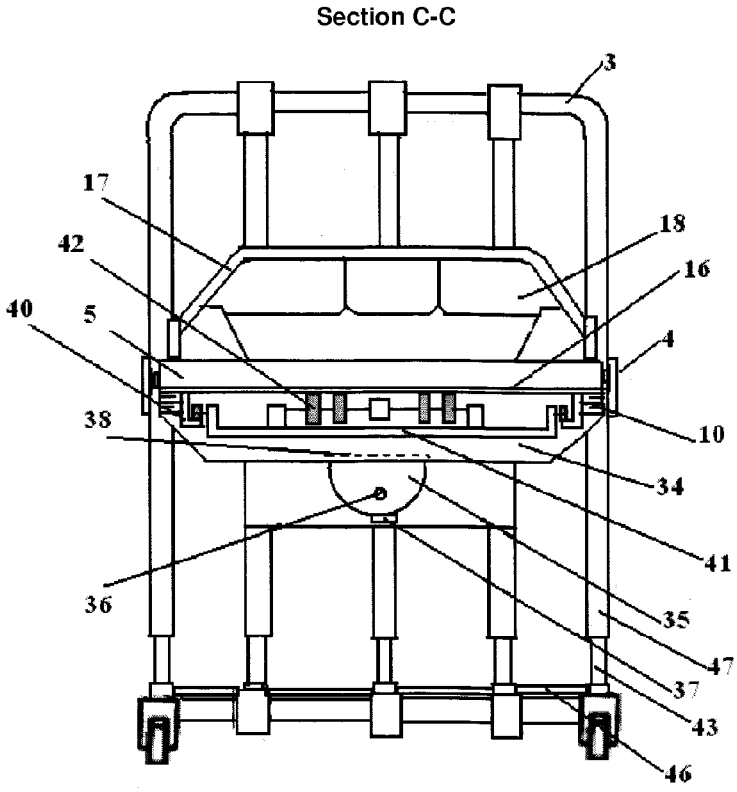
Figure 6:
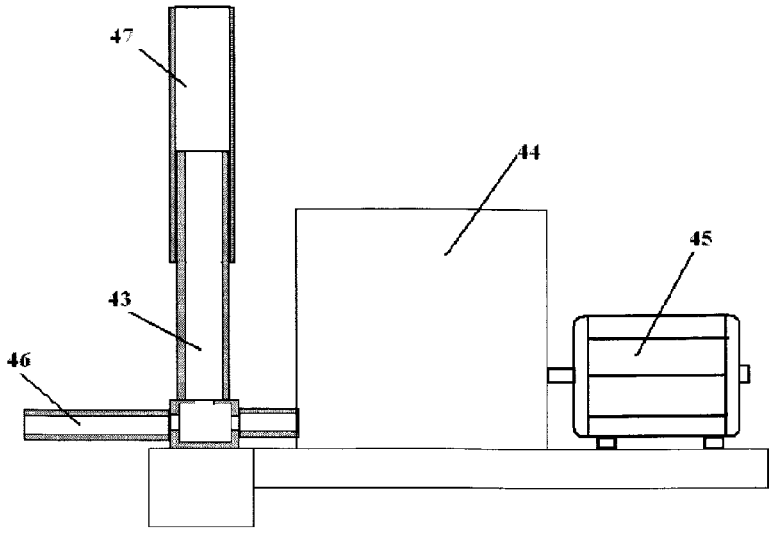

FIG. 1 shows the general view of the proposed bed;

FIG. 2—view A of FIG. 1;

FIG. 3—section B-B of FIG. 1;

FIG. 4—general view of the bed with lifted upper platform,

FIG. 5—section C-C of FIG. 4,

FIG. 6—frame vertical lifting device; and

Figure 7:
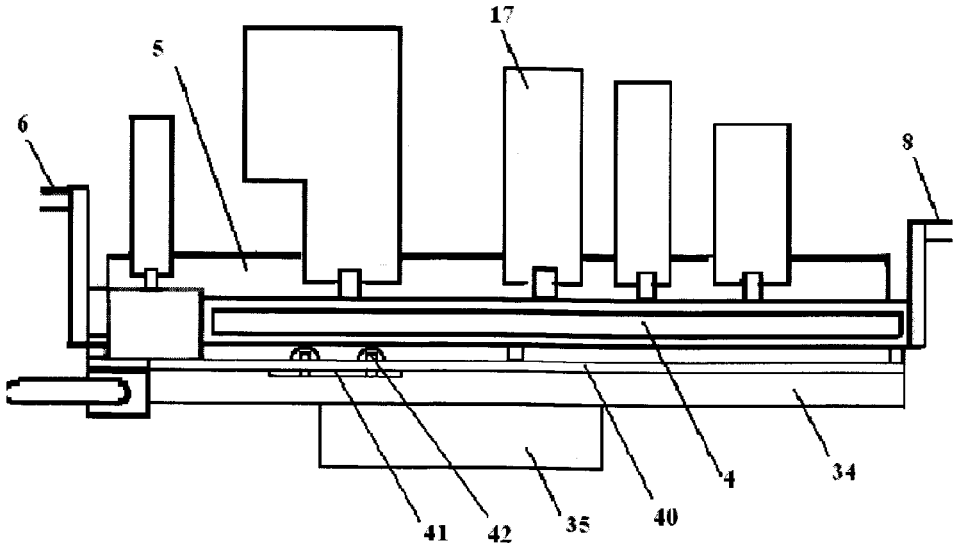

FIG. 7—section S-S of FIG. 1.

The multifunctional bed is comprised of base 1 with rigidly affixed bed-rails 2 and 3, frame 4, device for frame rotation around a horizontal axis, frame vertical tilting device, eccentric frame vibration device, frame vertical lifting device, and upper platform 5. Frame 4 is equipped, on one end side, with rod 6 with hinge 7, and on the other end side, with rod 8 with bracket 9 (FIG. 2), and runners 10 on inner lateral sides of frame 4. Upper platform 5 is located inside frame 4 and can be fixed in place with locks 11 (FIG. 2), affixed to the end side of frame 4. Upper platform 5 has rods 12 and 13 rigidly affixed to the lateral sides of the platform installed in hinges 14 and 15, affixed to the inner lateral sides of frame 4, and removable sectional net 16 (FIG. 5) On the lateral sides of upper platform 5 are installed removable pneumatic clamps 17 with inflatable pillows 18. The rotating device of frame 4 for rotation thereof around a horizontal axis includes actuator 19 and worm-and-worm pair-screw shaft 20, the ends of which are pivotally mounted in housing 21 of the actuator, and gear 22, one of the axles of which is connected to the actuator axle 19, and the other axle is connected, via coupling 23, to bracket 9, pivotally connected to crossbar 24, coupling 23 being pivotally connected to bed-rail 3, and one of the axles of shaft 20 ending in handle 25. The vibration device of frame 4 is located on the opposite, relative to the frame rotation device, end of the bed on the outer surface of bed-rail 2, and is mounted eccentrically; it is supplied with electric motor 26 and shaft 27 with rigidly affixed off-center drive 28, shaft 27 being connected via coupling 29 installed in bed-rail 2 and hinge 7 with axial rod 6. Upper platform tilting device 5 has carriage 30 and lead screw 31 passing through said carriage, pivotally installed with its ends in housing 32, the latter being rigidly affixed on the end portion of frame 4, and carriage 30 being pivotally connected to upper platform 5 by means of rack 33. The patient sanitation arrangement comprises removable sectional pallet 34, installed under upper platform 5, said pallet being fitted with rods inserted with a capability to move on multitiered runners 10 of frame 4, trough-like duct 35 placed under the pallet and equipped with water supply and sanitation waste removal fittings 36 and 37 (respectively), and removable cover 38 with handle 39. Rods in each section of the pallet are installed intermittently, vertically, each in their respective runners 10, and trough-like duct 35 is installed in the middle section of the pallet. The massaging device consists of rails 40 affixed to the lower parts of the lateral sides of upper platform 5, mobile carriage 41 and massaging rollers 42 on axles affixed to carriage 41. The device of vertically lifting frame 4 consists of hollow vertical tubes 43 telescopically installed in pneumatic tubes 47 of bed-rails 2 and 3, compressor 44 for the supply of a liquid under pressure with the help of electric actuator 45 into vertical tubes 43, and transportation tube 46, which form a single transportation system. Vertical tubes 43 are telescopically installed in vertical portions 47 of bed-rails. The arrangement of frame rotation is additionally equipped with a frame rotation control system, which consists of packet-type switch 48 for changeover of electric motor 19 to the necessary rotation mode or assigning a frame rotation angle, electronic device 49 for transmitting electronic control signals to electric motor 19 via packet-type switch 48, and drum lock 50 for locking the angle position of frame 4. Rotary packet-type switch 51 is intended for connecting video equipment and medical monitoring and life support equipment to upper platform 5, said video equipment being installed on rod 52. The additional vibration device consists of an electromagnetic actuator whose electromagnetic coil 53 and core 54 are installed on the base of the bed. The additional vibration device is intended for generating longitudinal-transverse vibrations of frame 4.

The operation of the proposed piece of equipment is performed as follows: Upper platform 5 is locked with locks 11 in frame 4; pneumatic clamps 17 are affixed along the edges of upper platform 5; the patient is laid on the upper platform 5 with his head to bed-rail 2 and feet to bed-rail 3 parallel to base 1; the patient is affixed with pneumatic clamps 17 with inflatable pillows 18 by forcing air into the inflatable pillows in order to completely cover the patient from all sides, including the head; the patient being turned over manually or automatically as necessary, with positions being fixed according to the preset program as necessary. The manual overturning of the patient is performed by turning the handle of the device to rotate frame 4, for which purpose screw shaft 20 is set into motion, thereby rotating gear 22 of the actuator; frame 4 is rotated via coupling 23 and rod 8 passing through bracket 9, and locked in the needed position; the patient at this time is lying on inflatable pillows 18 of pneumatic clamps 17, e.g. for sanitation of the body from the back. For this purpose, sections of net 16 are moved first in order to open access to the needed body part, e.g.: to perform sanitation of the lumbar region, a section of net 16 is first moved in the direction of the head or feet, then said section is removed and sanitation performed, completing which the section of net 16 is put back in place. Then screw shaft 20 is rotated again and frame 4 returned to the normal position. If it is necessary to use trough-like duct 35, handle 39 is used to open inner cover 38, water supply fitting 36 is switched on, and then, through fitting 37, waste water is washed away. Where it is necessary to perform spine or lower extremities stretching, one end of the upper platform may be elevated or lowered. For this purpose, electric motor 26 rotates shaft 27 driving carriage 30 to move along lead screw 31. For the purpose of increasing the tilt angle of upper platform 5, one can raise bed-rails 2 and 3 with the help of the frame vertical lifting device comprising hollow vertical tubes 43, compressor 44 and vertical elements 47 mounted in bed-rails. Upper platform 5, pivotally connected with frame 4, rotates relative to the frame to a preset angle with the help of drum lock 50, which locks the angular position of the frame, packet-type switch 48 and device 49, which transmits electronic control signals to electric motor 19. Device 49, via packet-type switch 48, may also perform pendular rotations of the upper platform to a certain angle. To ensure smaller increments of change in repositioning various patient body parts, longitudinal-transverse vibrations are generated. For this purpose, via coupling 29 and axial rod 6 connected to frame 4, low-frequency oscillations are transmitted from the eccentric vibration device to the upper platform. Where a tilted position of upper platform 5 is needed, locks 11 are released, lead screw 31 is rotated by means of the tilting device handle, which moves carriage 30 thus lifting rack 33, which in turn lifts one of the sides of upper platform 5 to a set angle due to its rotation on pins 12 and 13 installed in hinges 14 and 15. For the purpose of generating vibration fluctuations of frame 4, electric motor 26 is switched on and eccentric shaft 27 with disk 28 is rotated via coupling 29 at a set angular velocity. Fluctuations are transmitted via hinge 7 and rod 6 to frame 4 and upper platform 5. Where massage is needed, carriage 41 and massaging rollers 42 are brought to the relevant part of the patient's body, carriage 41 moving along the body surface on rails 40 to and fro with the necessary velocity. Rotation packet-type switch 51 allows for connecting necessary medical monitoring and life support equipment to the patient under the conditions of upper platform repositioning in space and in time. For the purpose of monitoring the patient's condition, video equipment affixed to rod 52 may be used. For the purpose of generating vibration fluctuations with changing parameters of frequency and amplitude, an additional vibration-generating device with electromagnetic coil 53 and core 54 may be used to induce vibrations of bed base 1 and, thereby, frame 4.

Thus, the proposed multifunctional bed enables to significantly improve the condition of seriously ill and bedridden patients by means of preventing stagnation in the respiratory system, stimulation of the gastrointestinal tract and blood circulation system. Patient overturning, repositioning and vibration modes are set on a patient-specific basis, depending on the patient's condition and doctor's prescriptions. Thus, the frequency of full rotations (360°) of the bed's upper platform may be from 1-2 to 4-5 and more per hour, with patient being held by the pneumatic clampers. The bed's upper platform can rotate for a certain time (10-30 min) per each 90 degrees, from back to side to stomach to other side and to back again. For washing and sanitation of the patient, there are special devices installed beneath the upper platform. Sanitation of the bedridden patient is performed on the bed. In order to keep the patient in place, a variety of tools are used (pneumatic breast jackets, latex pillows, and cotton and foam cushions). The bed is equipped with a massaging device for the patient, and video equipment for remote monitoring of the patient. In an automatic mode, the electronic device unit will transmit regular electric signals of a certain duration to the appropriate actuator, with the latter generating angular (pendular) oscillations of the bed frame to a set angle in either directions intermittently in order to withdraw loading from this or that part of the body, and also individual electric signals for the rotation of the frame to a set angle to provide conditions for the performance of patient care from the side of the back or other body parts. In case of certain seriously ill and bedridden patients, e.g. after spine, skull, abdominal cavity or thoracic cavity surgery, it is necessary to perform swinging (pendular) turns of the upper platform to an angle of up to 180°-240° every 5-10 or 30-45 minutes. Longitudinal and transverse vibrations of the bed frame are also admissible to provide for small increments of change in repositioning patient body parts. Such angular changes, pendular motions and longitudinal-transverse vibrations of the frame with a patient on the bed can be performed for a set period of time depending on the commands programmed in the electronic device. The lower portion of the upper platform is equipped with a pallet consisting of removable sections, which allows for easy washing of the bedridden patient, as well as conducting massage, redressing and any other medical procedures. Thus, the use of this invention contributes to the improvement of the quality of life of a seriously ill and bedridden patient, at the same time improving the ease of service and reducing labor intensity of patient care.

The invention claimed is:

1. A multifunctional bed comprised of a base, bed-rails, a frame with axial rods at its end portions, an upper platform installed in the frame, locking devices for the installation of the upper platform in the frame, removable pneumatic clamps for supporting the patient, a rotating device for the rotation of the frame around a horizontal axis with an actuator and a worm-and-worm pair connected to one of the axial rods, and a mechanical arrangement for vertically tilting the frame made in the form of a carriage moving along a lead screw and connected to the upper platform by means of a rack and hinges, characterized in that such bed is equipped with a device of vertically lifting the frame made in the form of hollow vertical tubes telescopically installed in the bed-rails and connected with each other to form a transportation system connected to a compressor for the supply of a liquid under pressure and to an electric actuator, also equipped with an eccentric frame vibration device connected to one of the bed axial rods, a sanitation arrangement constructed in the form of a sectional net and pallet installed beneath the upper platform, the sections thereof being removable, and a trough-shaped duct installed beneath the pallet and equipped with water supply and sanitation waste removal fittings, said sections of the net and pallet being installed with horizontal movement capability, said frame rotation device being additionally equipped with a frame rotation control system that includes an electronic device to transmit electronic control signals to the actuator, a packet-type switch for changing rotation modes or assigning frame rotation angle, and a drum lock for locking the frame angular position, said upper platform being equipped with pins located on its lateral sides installed by means of hinges on inner lateral sides of the frame.

2. A bed according to claim 1, characterized in that such bed is additionally equipped with a massaging device made in the form of a carriage installed with a capability to move along the patient's body, with massaging rollers being affixed thereto.

3. A bed according to claim 1, characterized in that such bed is additionally equipped with a vibration device made in the form of an electromagnetic actuator in the form of an electromagnetic coil and core installed in the base of the bed.

* * * * *

UNITED STATES PATENT AND TRADEMARK OFFICE

CERTIFICATE OF CORRECTION

PATENT NO. : 8,171,582 B1
APPLICATION NO. : 13/375760
DATED : May 8, 2012
INVENTOR(S) : Nikolaev et al.

It is certified that error appears in the above-identified patent and that said Letters Patent is hereby corrected as shown below:

Title page 1, column 1 (Item 73, Assignee), please change:

"Obshhestvo S Organichennoj Otvetstvennost'Yu Strojinzhiniring SM, Moscow (RU)" to --Obshhestvo S Ogranichennoj Otvetstvennost'Yu Strojinzhiniring SM, Moscow (RU)--.

Signed and Sealed this
Second Day of October, 2012

David J. Kappos

David J. Kappos
*Director of the United States Patent and Trademark Office*